US005881525A

United States Patent [19]

Riegelman et al.

[11] Patent Number: 5,881,525

[45] Date of Patent: Mar. 16, 1999

[54] WINDOW SCREEN FRAME

[75] Inventors: Harry M. Riegelman, Arlington, Tex.; Melvin J. Stern, Las Vegas, Nev.

[73] Assignee: Harmel Automation, Inc., Arlington, Tex.

[21] Appl. No.: 958,650

[22] Filed: Oct. 27, 1997

[51] Int. Cl.[6] ..... E04C 2/38

[52] U.S. Cl. ..... 52/656.7; 49/504; 160/381; 160/377

[58] Field of Search ..... 52/656.7, 656.5; 160/381, 377; 49/504; 29/897.312, 453

[56] References Cited

U.S. PATENT DOCUMENTS

| | | | |
|---|---|---|---|
| 1,596,950 | 8/1926 | Semonin | 160/371 |
| 1,695,091 | 12/1928 | Everhard | 160/371 CR |
| 1,775,717 | 9/1930 | Everhard | 160/371 CR |
| 2,006,925 | 7/1935 | Klemp | 153/2 |
| 2,045,770 | 6/1936 | Golden | 160/381 CR |
| 2,094,991 | 10/1937 | Lang | 156/14 |
| 2,312,721 | 3/1943 | Lang | 160/381 |
| 3,097,684 | 7/1963 | Le Torte | 153/2 |
| 3,327,766 | 6/1967 | Kurz | 160/381 |
| 3,376,670 | 4/1968 | Jones | 49/501 |
| 3,879,894 | 4/1975 | Anderson | 49/420 |
| 4,112,622 | 9/1978 | Stewart | 49/421 |
| 4,357,744 | 11/1982 | McKenzie et al. | 29/453 X |
| 4,420,920 | 12/1983 | Hewitt | 52/309 |
| 4,462,237 | 7/1984 | Kauferle et al. | 72/324 |
| 4,503,640 | 3/1985 | Stern | 49/425 |
| 4,562,677 | 1/1986 | Hrabák | 52/211 |
| 4,628,582 | 12/1986 | Leopold | 29/453 X |
| 4,665,652 | 5/1987 | Discher et al. | 49/460 |
| 5,018,263 | 5/1991 | Stern | 29/469.5 |

*Primary Examiner*—Creighton Smith
*Attorney, Agent, or Firm*—Robert A. Seemann

[57] ABSTRACT

A screen frame formed from a metal sheet in a single unit folds and locks on V-cuts in a tube by a locking mechanism that is configured to engage in crossed directions by the folding.

12 Claims, 4 Drawing Sheets

WINDOW SCREEN FRAME

BACKGROUND OF THE INVENTION

1. Field of the Invention

The invention pertains to window screen frames, more particularly to a window screen frame that is made by folding a strip of formed stock.

2. Description of the Prior Art

The prior art is replete with patents for screen frames made by folding a strip of formed stock.

U.S. Pat. No. 1,596,950 patented Aug. 24, 1926 by P. F. Semonin describes a stamped sheet metal strip folded into a frame. A narrow longitudinal portion of the strip forms the outer wall of the frame. The side walls of the frame are 90 degree folded upward portions of the strip which are each folded again toward one another so that a longitudinal slot is formed along the inner center of each leg of the frame by the facing edges of the side walls. At a transverse folding line across the strip for making a corner, opposite portions of the side walls are removed each by 90 degree and 45 degree cuts which meet at the longitudinal fold line between the side wall and the narrow longitudinal portion. When the fold is made, the 90 degree and the 45 degree cuts in each wall abut. A hole near each corner is formed by circular notches in the facing edges of the longitudinal slot so that a rod mounting one side of the screen can be held within the leg behind the slot in each of two opposing legs of the frame.

U.S. Pat. No. 5,018,263 patented May 28, 1991 by M. J. Stern describes a continuous thin die cut metal strip which when folded to form a corner of a frame, has the side walls of one leg of the frame epoxy fastened within the adjacent leg of the frame to 45 degree end-cut side walls of the adjacent leg. The side walls are further formed into longitudinal channels extending the length of each leg for receiving screen fabric.

SUMMARY OF THE INVENTION

It is on object of the invention to provide a screen frame that is formed from a single sheet of metal.

It is another object the frame can be made by folding the sheet into a tube and screen holding element, and folding the tube to form corners of the frame.

It is another object that the tube wall that faces toward the inside of the frame locks the tube into the fold.

It is another object that compound lock means is operated by folding the tube to lock the fold.

A metallic frame for a screen, formed from a metal sheet in a single unit includes an outer wall connected to a first side wall and to a second side wall that is opposite the first side wall, and an inner wall connected to the first side wall and to the second side wall, the outer wall, first side wall, second side wall, and inner wall form a tube in which the inner wall is closed.

A first V-cut across the tube extends through the inner wall the first side wall and the second side wall, and has an apex at the outer wall.

The outer wall has a fold at the apex which forms a first corner of the screen frame and makes of the tube a first leg of the frame and a second leg of the frame attached to the first leg by the outer wall at the first corner.

Means for holding screen fabric extends from the tube.

Locking means comprising the inner wall and one of the first side wall and the second side wall is configured to move in the direction of the fold and crosswise to the direction of the fold for locking the tube into the fold when the tube is folded at the apex.

In the locking means preferably a first portion of the inner wall on the first leg extends through the inner wall on the second leg and holds the fold closed.

The first portion is preferably spaced from the first side wall and the second side wall.

The tube includes catch means on the inner wall at the first end of the tube, and the frame further includes an insert mounted in the tube and spring hook means on the insert in the catch means. The insert attaches the first end to the second end at a corner of the frame.

The catch means is preferably spaced from the first side wall and from the second side wall.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 2:
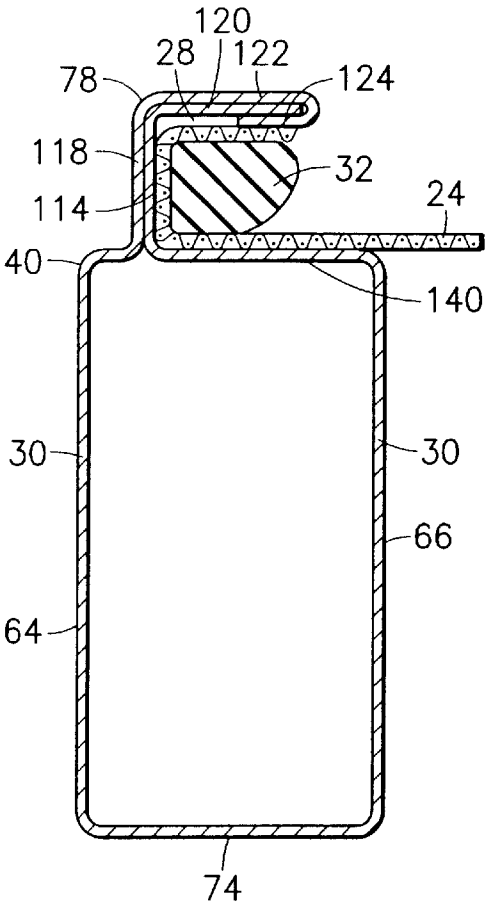
FIG. 2 is a cross section view of a leg of the frame of FIG. 1 taken along line 2—2 and rotated.
Figure 1:
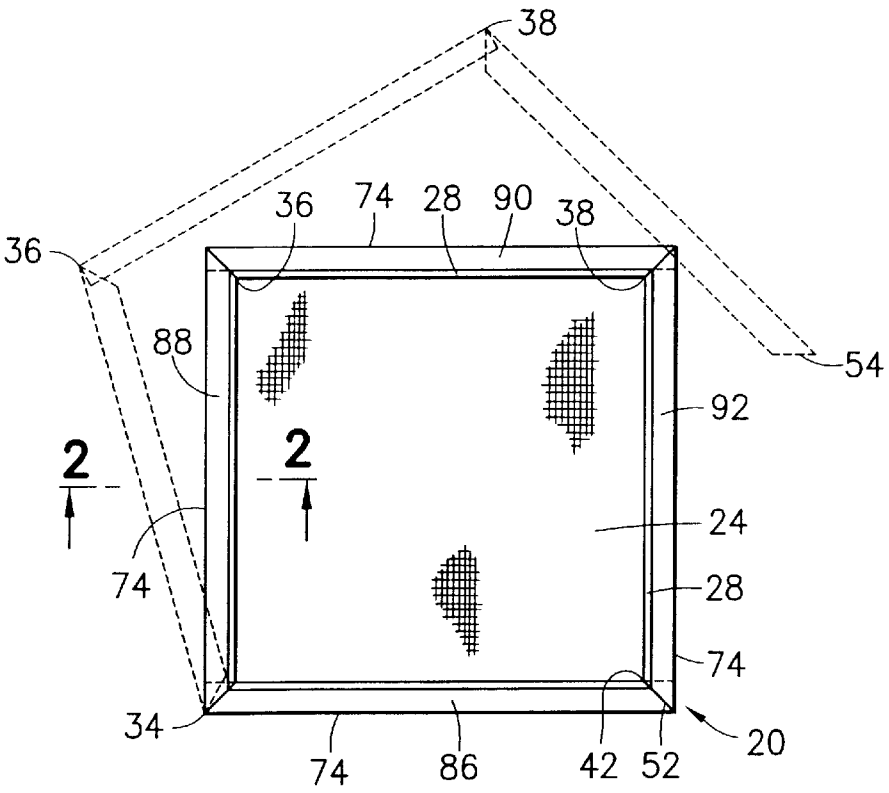
FIG. 1 is a front schematic view of an assembled frame of the invention, and in broken line three legs of the frame in a position before they are folded to make the frame.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to FIGS. 1 through 5, frame 20 is designed to receive as window screen 24 which is held in channel 28 by rubber spline 32.

Corners 34, 36, and 38 of frame 20 are made by folding stock strip 40 on fold lines 44, 46 and 48 respectively which coincide respectively with the apexes of V-cut pairs 45, 50; 47, 51; and 49, 53.

Corner 42 is made by attaching ends 52 and 54 of the frame length segment of stock strip 40 together.

Figure 3:
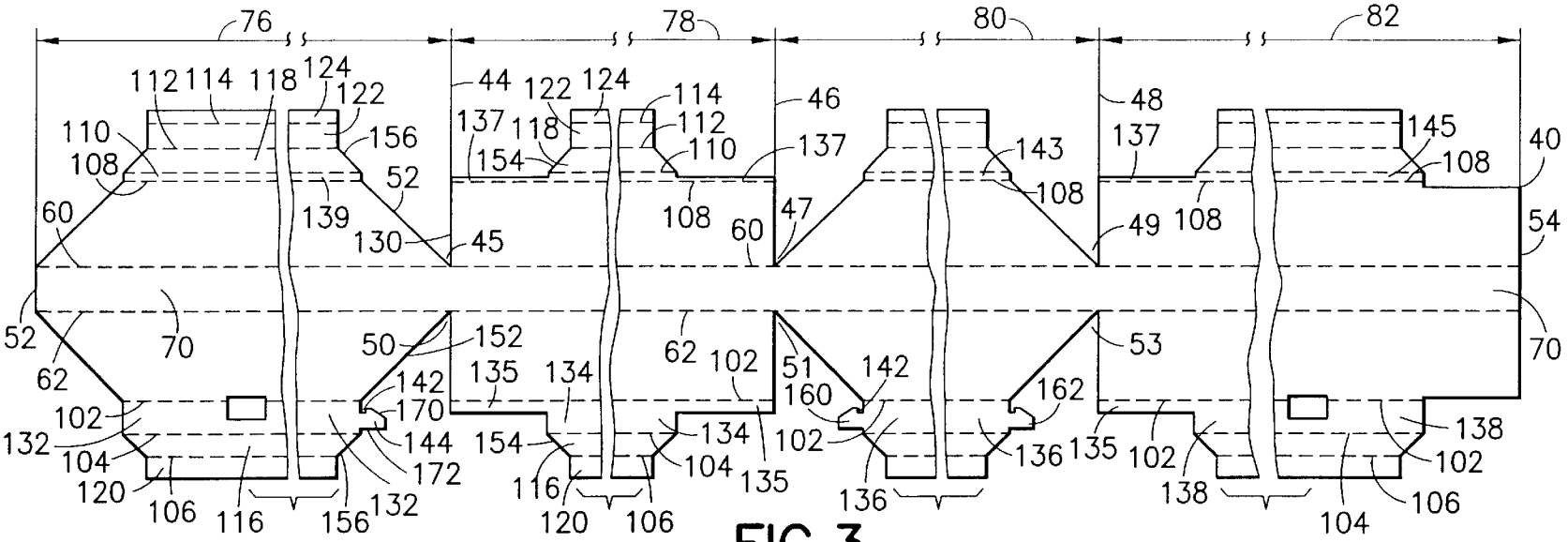
FIG. 3 is a top schematic view of the flat metal strip blank for constructing the frame of FIG. 1.
Figure 4:
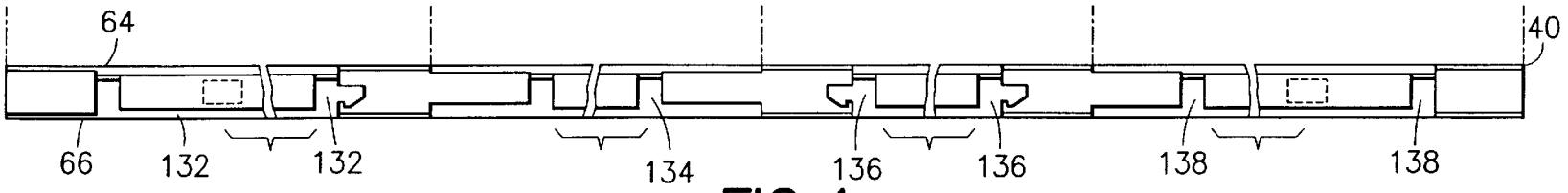
FIG. 4 is a top view of the blank of FIG. 1, folded longitudinally for constructing the frame of FIG. 1.
Figure 5:
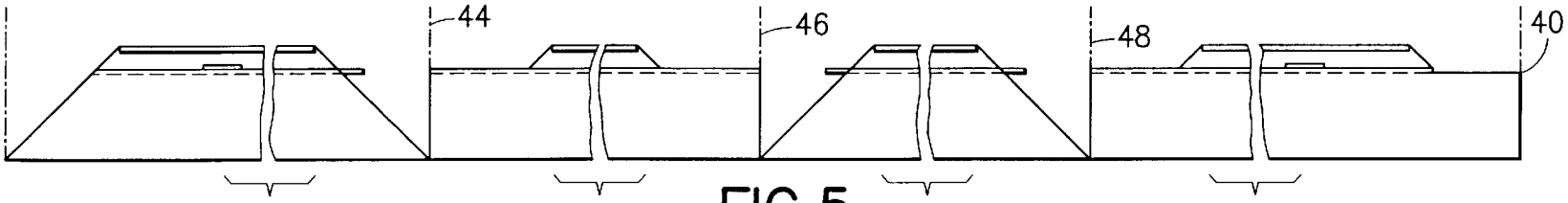
FIG. 5 is a front view of the blank of FIG. 4.
Figure 6:
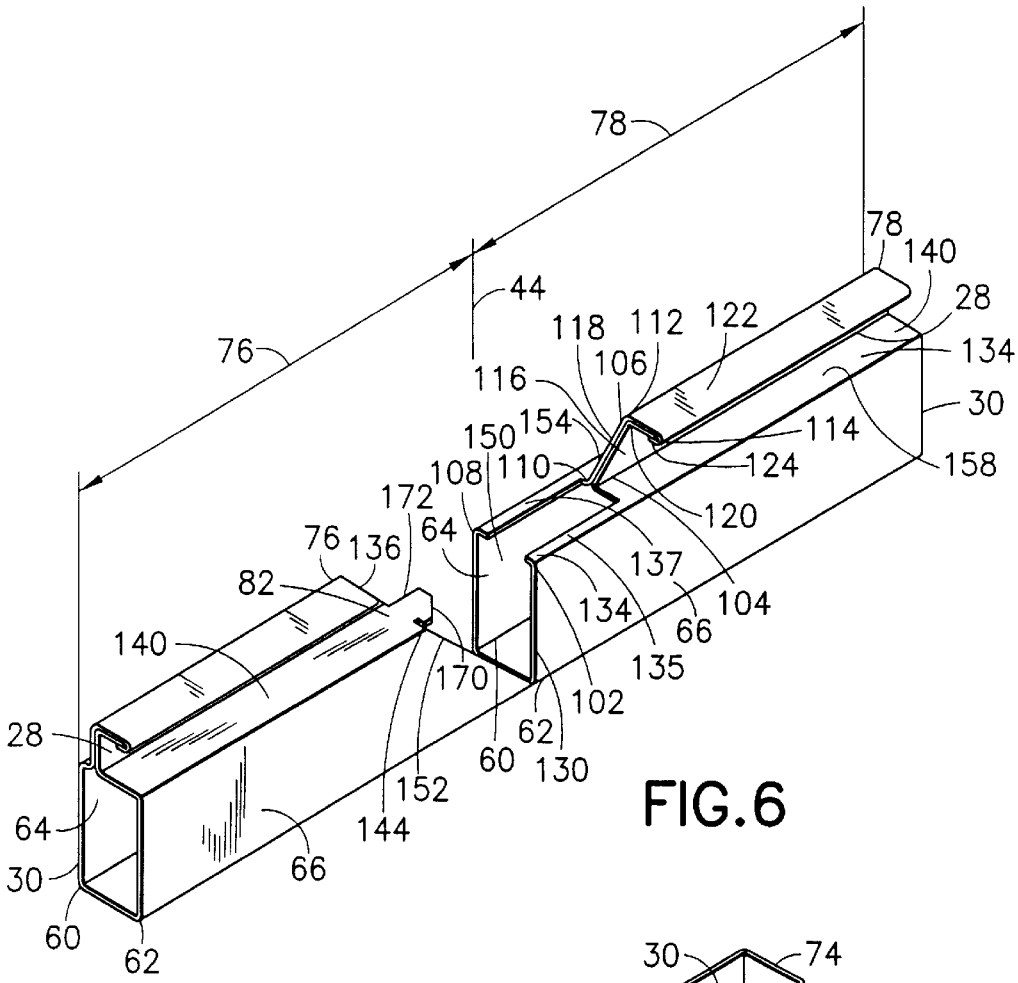
FIG. 6 is a perspective view of a corner section of the longitudinally folded blank of FIG. 4. Only the corner ends of the frame legs are shown.
Figure 7:
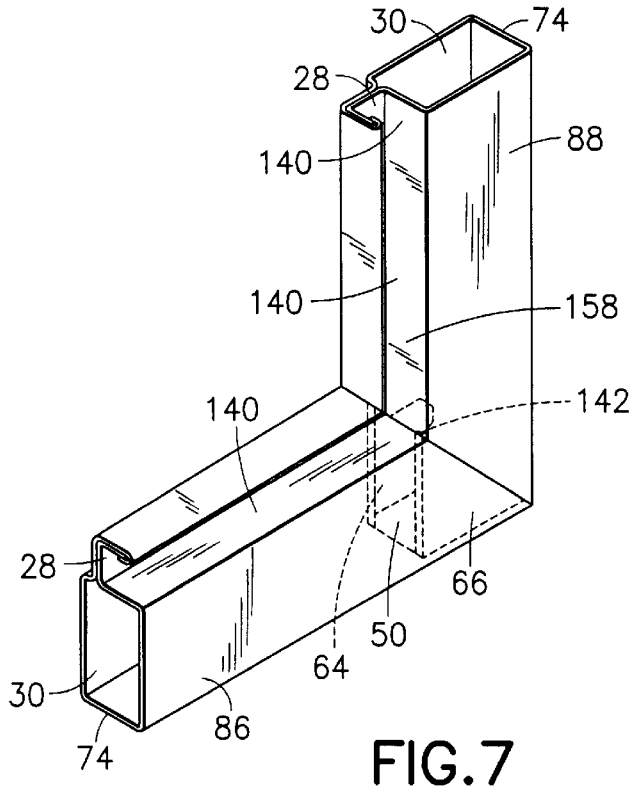
FIG. 7 is a perspective view of the corner section of FIG. 6, folded into a completed corner. Only the corner ends of the frame legs are shown.
Figure 8:
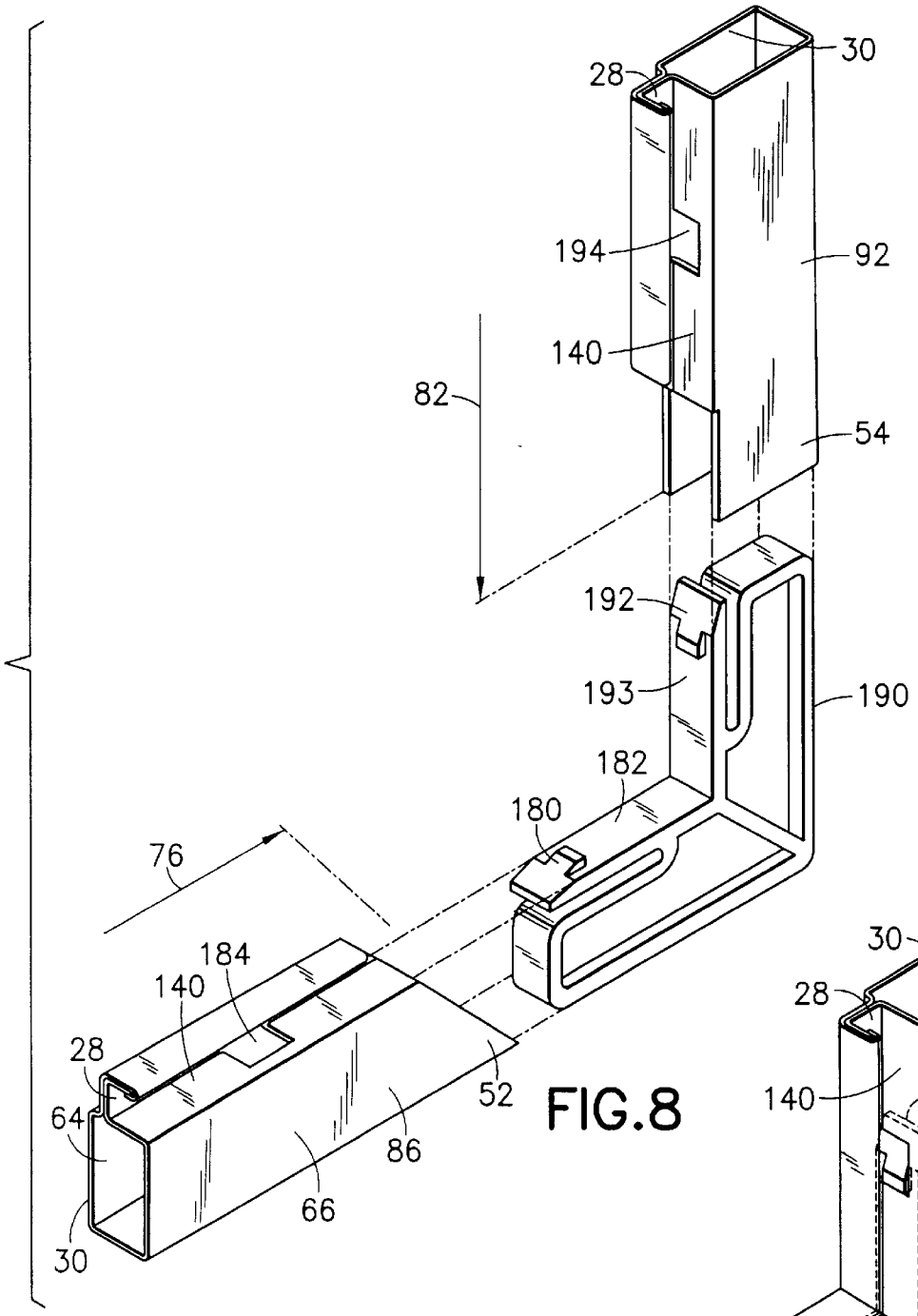
FIG. 8 is a perspective view of the extreme ends of the blank of FIG. 4 oriented for attaching together by a corner fastener. Only the corner ends of the frame legs are shown.
Figure 9:
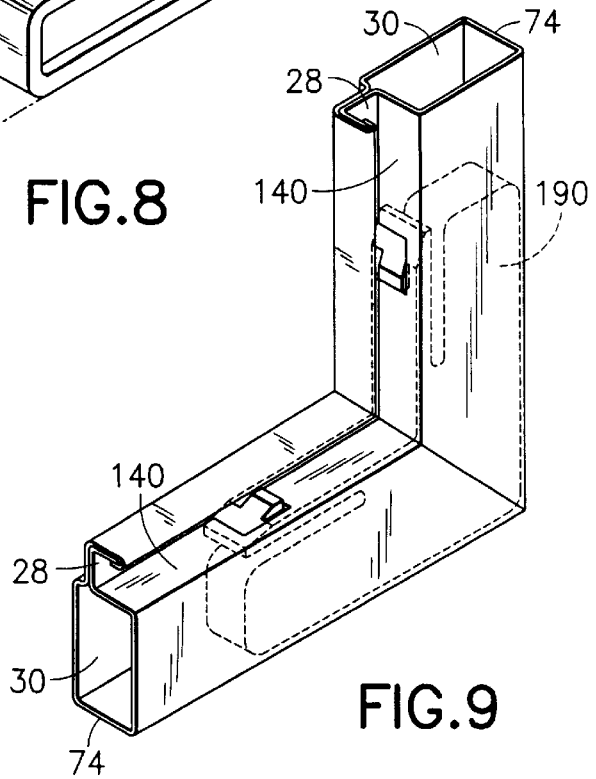
FIG. 9 is a perspective view of the corner ends of the legs of FIG. 8 attached together by the corner fastener.

Stock strip 40 is preferably made by stamping from sheet metal ribbon in a continuous operation. Individual frame length segments are then separated from the ribbon. FIG. 3 shows one frame length.

Referring to FIGS. 1–7, stock strip 40 is folded to about 90 degrees along longitudinal lines 60 and 62 to form side walls 64 and 66. Strip 70 forms outer wall 74 of the frame.

Sections 76, 78, 80 and 82 respectively form legs 86, 88, 90, and 92 of the frame.

Fold lines 44, 46, and 48 form corners 34, 36, and 38 respectively.

In section 78, the thin wall sheet metal is folded at fold lines 60, 62, 108, and 102 to form tube 30, and folded on lines 104, 106, 110, 112, and 114 to make channel 28.

In channel 28, strip 116 is covered by strip 118, and strip 120 is covered by strips 122 and 124.

Inner wall 140 of the frame comprises strip 132 in section 76, combination strips 135 and 134, in section 78, strip 136 in section 80, and strip 138 in section 82 which are adjacent to fold line 102, and strip 139, 137, 143, and 145 which are adjacent to fold line 108 in sections 76, 78, 80 and 82 respectively.

Outer wall 74, side walls 64 and 66, and inner wall 140 are continuous around the tube, extending along a longitudinal portion of each leg.

In section 76, strip 40 folds on lines 60, 62, 108, and 102 to form tube 30. Folds on lines 104, 106, 110, 112, and 114 form channel 28 wherein strip 116 is covered by strip 118, and strip 120 is covered by strips 122 and 124 like in section 78.

When stock strip 40 is folded on fold line 44, square cut end 130 of tube 30 portion of section 78 extends into tube 30 portion of section 76 where 45 degree angle cut end 152 of tube 30 portion of section 76 abuts against inner wall 140 of section 78. 45 degree angle cut end 154 of channel 30 portion of section 78 abuts against 45 degree angle cut end 156 of channel 30 of section 76.

Tab 144 of leg 88 extends from inner wall 140 generally parallel with inner wall 140 and transverse to the length of leg 86 side walls 64, 66 at the center of inner wall 140, spaced from side walls 64, 66, through inner wall 140 into tube 30 and hooks by notch 142 onto wall 140, behind wall 140.

Tube 30 is the same diameter on both sides of the V-cut. When walls 64 and 66 of the section 78 leg are inserted into tube 30 between walls 64 and 66 of the section 76 leg, side walls 64 and 66 of the section 78 leg are forced toward one another about slot 150. Strips 135 and 137 provide a spring out resistance to the closing force that makes the telescoping walls fit tightly together which prevents twisting of the frame at the folded corner. When the fold is completed, walls 64 and 66 about slot 150 are forced closer together where they are inserted in the tube than where they are attached to wall 140 where it is closed 158, which moves strips 135 and 137 closer together on tab 144 locking it between them.

When stock strip 40 is folded at line 46, tab 160 locks behind strips 135 and 137 which comprise inner wall 140 at section 78.

When stock strip 40 is folded at line 48, tab 162 locks behind strips 135 and 137 which comprise inner wall 140 at section 82.

When stock strip 40 is folded into being a corner, tab 144 cam surfaces 170 and 172 bear laterally against inner wall strips 135 and 137 as the tab enters through inner wall 140, so that tab 144 cams strips 135 and 137 further apart and also cams side walls 64 and 66 further apart. This is in opposition to the squeezing force applied by the tube that they enter.

When the stock strip is folded into a corner on line 46, tab 160 of section 80 enters through inner wall 140, spreading apart strips 135 and 137 of inner wall 140 of section 78 and locks behind them within the tube of that leg.

When the stock strip is folded into a corner on line 48, tab 162 enters through inner wall 140, spreading apart strips 135 and 137 of inner wall 140 of section 82 and locks behind them within the tube of that leg.

Referring now to FIGS. 1–5, 8, and 9, hook 180 on resilient arm 182 is forced into hole 184 in inner wall 140 by arm 182 when plastic bracket 190 is forced into tube 30 at end 52 of section 76.

Plastic bracket 190 closely fits tube 30. The configuration prevents rotation or cocking of tube 30.

Hook 192 on resilient arm 193 fits into hole 194 in inner wall 140 when the bracket is forced into tube 30 at end 54 of section 82.

While the preferred embodiment of the invention has been shown and described, it will be understood that the invention may be embodied otherwise than as herein specifically illustrated or described, and that certain changes in form and arrangement of parts and in the specific manner of practicing the invention may be made without departing from the underlying idea or principles of this invention within the scope of the appended claims.

What is claimed is:

1. A metallic frame formed from a metal sheet in a single unit comprising:

an outer wall connected to a first side wall and to a second side wall that is opposite said first side wall, an inner wall connected to said first side wall and to said second side wall, said outer wall, first side wall, second side wall, and inner wall forming a tube in which said inner wall is closed, a first V-cut across said tube extending through said inner wall, said first side wall and said second side wall, and having an apex at said outer wall, said outer wall having a fold at said apex forming a first corner of said frame and making of said tube, a first leg of said frame and a second leg of said frame attached to said first leg by said outer wall at said first corner, a first portion of the inner wall on said first leg extending through the inner wall on said second leg, holding the fold closed, and said tube comprising means for holding screen fabric.

2. The frame of claim 1, wherein said first portion is spaced from said first side wall and said second side wall.

3. The frame of claim 1, wherein said first portion and said inner wall comprise cam means.

4. The frame of claim 1, further comprising cam means between said first portion and the first and second side walls.

5. The frame of claim 1, wherein said first V-cut comprises an acute angle on said first leg, said second leg extending into said acute angle cut leg.

6. The frame of claim 5, further comprising locking strips on said second leg which move toward one another about said first portion for locking said first portion in the inner wall of said second leg when the first and second legs are folded on said apex.

7. The frame of claim 6, wherein said locking strips comprise the inner wall of said second leg.

8. The frame of claim 1, wherein said first V-cut comprises an acute angle on one of said first and said second legs, and a right angle cut on the other of said first and said second legs, said right angle cut leg extending into said acute angle cut leg.

9. The frame of claim 8, further comprising locking strips on said right angle cut leg which move toward one another about said first portion for locking said first portion in the inner wall of said right angle cut leg when the first and second legs are folded on said apex.

10. The frame of claim 1, wherein said tube formed of said metal sheet has a first end and a second end, and further comprises catch means on said inner wall at said first end, and said frame further comprises an insert mounted in said tube and spring hook means on said insert in said catch means, said insert attaching said first end to said second end at a corner of said frame.

11. The frame of claim 10, wherein said catch means is spaced from said first side wall and from said second side wall.

12. A metallic frame formed from a metal sheet in a single unit comprising:

an outer wall connected to a first side wall and to a second side wall that is opposite said first side wall, an inner wall connected to said first side wall and to said second side wall, said outer wall, first side wall, second side wall, and inner wall forming a tube in which said inner wall is closed, a first V-cut across said tube extending through said inner wall said first side wall and said second side wall, and having an apex at said outer wall, said outer wall having a fold at said apex forming a first corner of said screen frame and making of said tube a first leg of said frame and a second leg of said frame attached to said first leg by said outer wall at said first corner, locking means comprising a first portion of said inner wall on said first leg and a flange on said second leg on said first side wall extending toward said second side wall in the general plane of said inner wall configured to engage said first portion extending through the plane of said inner wall locking the tube into the fold when the tube is folded at the apex, and said tube comprising means for holding screen fabric.

* * * * *